United States Patent [19]

Yvard

[11] 3,949,406

[45] Apr. 6, 1976

[54] HORN FOR RADIOELECTRIC ANTENNAS

[75] Inventor: Marcel Yvard, Arpajon, France

[73] Assignee: Compagnie Industrielle des Telecommunications Cit-Alcatel, Paris, France

[22] Filed: Feb. 28, 1975

[21] Appl. No.: 554,213

[30] Foreign Application Priority Data

Mar. 8, 1974 France ..... 74.08013

[52] U.S. Cl. ..... 343/786

[51] Int. Cl.[2] ..... H01Q 13/02

[58] Field of Search..... 343/781, 786, 840

[56] References Cited

UNITED STATES PATENTS 3,754,273 8/1973 Takeichi et al. ..... 343/786

FOREIGN PATENTS OR APPLICATIONS 251,026 1/1970 U.S.S.R. ..... 343/786

OTHER PUBLICATIONS

Davis; Corrugations Improve Monopulse Feed Horns; Microwaves; Apr. 1972, pp. 58, 59, 60.

*Primary Examiner*—Eli Lieberman

*Attorney, Agent, or Firm*—Haseltine, Lake & Waters

[57] ABSTRACT

Radioelectric antennas for hertzian beams with construction simplifying the manufacturing of a horn for such an antenna whose inside surface is corrugated. The horn comprises an outside sheet metal support on the inside of which is installed, one beside another, a great number of rings, having a shape such that two adjacent rings form a corrugation. Such structure enables economical manufacturing and facilitates adapting to various shapes of corrugations in the same horn.

7 Claims, 2 Drawing Figures

HORN FOR RADIOELECTRIC ANTENNAS

The invention relates to antennas for hertzian beams and more particularly to horns for radioelectric antennas which are internally provided with corrugations extending perpendicularly to the axis of the horn.

Radioelectric horn antennas which are used for the receiving and emitting of decimetric waves or shorter waves are known. It is known that their response can be improved if it is possible to reduce the surface current by providing the inside surface of the horn with a great number of corrugations extending perpendicularly to the axis of the horn. The geometrical configuration of these corrugations is chosen in such a way that the impedance for the frequencies considered is very high between two edges of adjacent corrugations. Thus, the surface waves are dispensed with and the efficiency of the antenna is increased; it is also observed that the main lobe is very symmetrical in relation to the axis of the horn.

To obtain these results, the depth of the corrugations must be well-defined in relation to the wavelength considered. It has, for example, been found that it is useful to vary that depth linearly between the large opening of the horn (slight depth) and the small opening of the horn (great depth). It is evident that such requirement complicate considerably the manufacturing of the horn if it is realized that a horn can measure more than four meteres and comprise several hundreds of corrugations.

The invention aims at reducing the maufacturing costs of such a corrugated horn, that horn being characterized in that it consists of an outside sheet metal support and a great number of rings, each ring being formed by an outside part called a base, by which it bears narrowly against the neighbouring rings and against the inside surface of the metal sheet, and of an inside part called the head having a slight thickness, in the horn; each corrugation is limited by the heads of two adjacent rings.

The basic concept of the invention is therefore to decompose the surface which is electrically active into a great number of elements which are more or less identical which may therfore be manufactured individually and which do not require the machining of corrugations.

To make the installing of the rings easier, it is an advantage to arrange the inside surface of the sheet metal support in a staircase configuration each of whose steps bears at least two rings.

The rings on the same step of the staircase may have an identical shape.

It is known to subdivide horns having a great length into several parts and to compose horns by means of connection flanges between the parts, these flanges being situated in planes perpendicular to the axis of the horn. In such a configuration, an embodiment of the invention which affords a particular advantage is characterized in that the bases of the end rings of each part comprise extensions towards the outside by which these rings are applied against the face of the corresponding part. It is then possible to screw the two end rings of each part parallel to the axis of the horn against the faces of the metal sheet.

The invention will be described hereinafter in greater detail with reference to an embodiment which is shown in the drawing.

Figure 1:
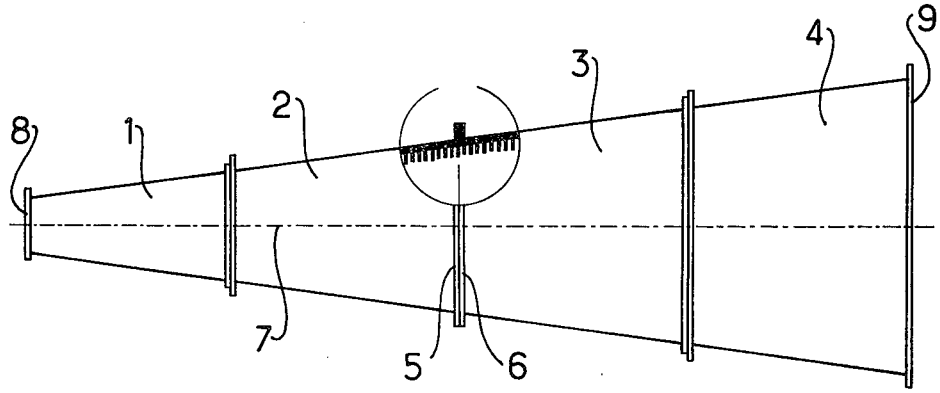
FIG. 1 shows a partly cut away view of a horn according to the invention.

With reference to FIG. 1, it will be observed that the horn consists of four parts 1, 2, 3, and 4 which are connected together by means of flanges, for example 5 and 6. These flanges are situated in a plane perpendicular to the axis 7 of the horn whose cross-section may be circular or rectangular. The inside diameter of the horn increases from its input face 8 which, during operation, is connected to a wave guide, which is not shown, up to its output face 9 which is closed by a non-metallic protective radome. The increase in diameter may be linear or non-linerar.

Figure 2:
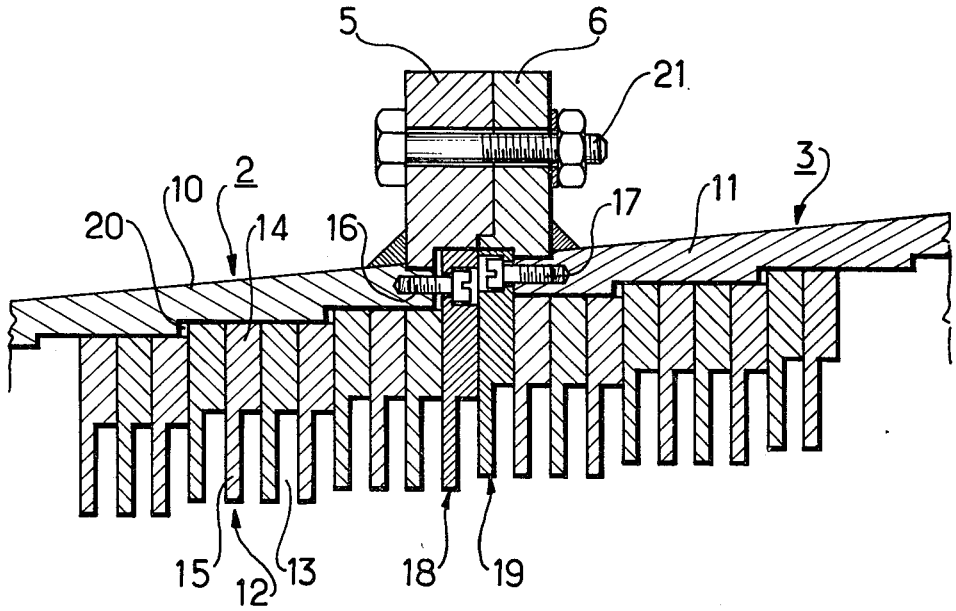
FIg. 2 shows a detail of the horn according to FIG. 1

The inside surface of the horn is covered with a corrugated structure which is seen in greater detail in FIG. 2. That figure shows a cross-section through the wall of the horn in the region of the connection between the part 2 and the part 3. It will be seen that this wall is constituted by an outside sheet metal support 10 and 11 respectively made of a light material and a great number of rings, such as, for example, 12, which are supported by the metal sheet and which have a shape such that each corrugation, for example 13, is limited by two adjacent rings.

It may be seen that each ring has an outside part called the base 14 having a rectangular cross-section and an inside part 15 also having a rectangular cross-section but reduced thickness; said inside part is called the head. It will also be observed that the inside surface of the metal sheet is machined in a starcase configuration, the width of each step being chosen for accomodating four adjacent rings on a step. As many rings having a different outside diameter as there are steps on the staircase are provided. At the time of the assembling, the rings are successively assembled in each part of the horn, starting with the smallest diameter, fixing only the first ring and the last ring of each part with a screw 16 and 17 respectively against the metal sheet. That screw passes through an extension which is provided only on the end rings 18 and 19 respectively and enters parallel to the axis 7 of the horn into the metal sheet 10 or 11 ( see FIG. 2) or else in the flange 5 or 6. It will also be seen that the width of the steps of the staircase on the inside face of the metal sheet is such that after the assembling at the bottom of each step, a small circular space 20 remains empty. Good contact between the bases of all the rings of the same part, which effectively bear against each other, is thus ensured. In that case, it is not necessary to connect together the adjacent rings by a weld and the structure reacts for high frequencies like a conventional structure having corrugations machined in the metal sheet.

The different parts of the horn may be provided one by one with their rings and it is finally possible to join together the various parts by means of screws 21 which assemble the flanges.

In the horn according to the invention, the geometrical configuration of the corrugations may easily be modified according to the requirements of the manufacturer. Corrugations having different depths may be provided from one end to the other of the horn; it has been observed that the electrical reaction of the horn remains practically undeteriorated if a shape identical for all the rings of the step of the staricase is chosen, this making manufacturing and storing of the rings easier.

The invention is not limited to the embodiment described hereinabove. The heads 15 may be machined in such a way that the set of heads surrounds a regular cone. A ring whose head is situated symmetrically on the base can also be designed. Lastly each ring could consist of two disks having a rectangular cross-section, one of which limits the bottom of the corrugation and the other of which limits the lateral faces. The rings are preferably made of light cast iron.

I claim:

1. A horn for radioelectric antennas comprising an outside sheet metal support having inner and outer surfaces, a plurality of juxtaposed rings extending inwardly into said support at the inner surface thereof, and means assembling said rings to said support, each ring comprising a base portion and a projecting portion, said projecting portion being narrower than the base portion, said rings bearing against one another and against said inner surface of the sheet metal support at said base portions, the projecting portions of adjacent rings defining a corrugation space therebetween.

2. A horn as claimed in claim 1 wherein said rings are identical to one another.

3. A horn as claimed in claim 1 wherein the inside surface of said support is of stepped configuration, at least two rings being assembled on each step.

4. A horn as claimed in claim 3 wherein the rings on each step are identical to one another.

5. A horn as claimed in claim 1 wherein said support includes a plurality of portions each comprising a connecting flange situated in a plane perpendicular to the axis of the horn, said rings including end rings at the opposite ends of the juxtaposed assembly, said end rings including extensions applied endwise against the associated support position.

6. A horn as claimed in claim 5 wherein said assembling means includes fastening means joining the end rings to the associated support portion.

7. A horn as claimed in claim 5 wherein said assembling means further comprises additional fastener means joining adjacent connection flanges of successive suport portions.

* * * * *